US007618022B2

(12) United States Patent
Thurner

(10) Patent No.: US 7,618,022 B2
(45) Date of Patent: Nov. 17, 2009

(54) TENSIONING DEVICE FOR USE AT A STAND FOR CLAMPING A ROD-SHAPED UNIT, PARTICULARLY A CHRISTMAS TREE, AND A STAND WITH A TENSIONING DEVICE

(75) Inventor: Gunther Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 127 days.

(21) Appl. No.: 11/723,130

(22) Filed: Mar. 16, 2007

(65) Prior Publication Data

US 2007/0235621 A1 Oct. 11, 2007

(30) Foreign Application Priority Data

Mar. 17, 2006 (DE) ..... 10 2006 012 424

(51) Int. Cl.
*B66F 3/00* (2006.01)

(52) U.S. Cl. ..... 254/223; 254/213; 254/227; 248/519; 47/40.5; 24/69 ST; 24/71 ST

(58) Field of Classification Search ..... 254/213, 254/215, 222, 223, 227; 248/523, 525, 519; 24/69 ST, 69 CT, 71 ST, 68 CD; 47/40.5
See application file for complete search history.

(56) References Cited

U.S. PATENT DOCUMENTS

| | | | | |
|---|---|---|---|---|
| 1,467,860 | A * | 9/1923 | Lampert | 24/269 |
| 5,114,113 | A | 5/1992 | Krinner | |
| 5,490,350 | A | 2/1996 | Eisenschenk et al. | |
| 5,797,579 | A | 8/1998 | Krinner | |
| 6,178,603 | B1 * | 1/2001 | Lillig | 24/132 R |
| D444,412 | S | 7/2001 | Krinner et al. | |
| D449,560 | S | 10/2001 | Krinner et al. | |
| D454,518 | S | 3/2002 | Krinner et al. | |
| 6,419,202 | B1 * | 7/2002 | Thurner | 248/525 |
| 6,877,708 | B1 * | 4/2005 | Thurner | 248/519 |
| 7,341,234 | B2 * | 3/2008 | Kowalski | 248/523 |
| 7,347,400 | B2 | 3/2008 | Thurner et al. | |
| 2004/0135042 | A1 * | 7/2004 | Krinner et al. | 248/158 |

FOREIGN PATENT DOCUMENTS

| | | |
|---|---|---|
| DE | 39 32 473 | 2/1992 |
| DE | 195 45 471 | 6/1997 |
| DE | 296 22 984 | 12/1997 |
| DE | 196 32 305 | 2/1998 |
| DE | 299 04 435 | 7/1999 |

(Continued)

*Primary Examiner*—Emmanuel M Marcelo
(74) *Attorney, Agent, or Firm*—Davidson Berquist Jackson & Gowdey LLP

(57) ABSTRACT

Described are a tensioning device and a stand having a tensioning device of this type. In a stand for clamping rod-shaped units (Christmas trees), a flexible force transfer element (wire rope) (4) is wound on a rotatable tensioning body (5) and thus tightened. The rotatable tensioning body (5) is rotated about its rotation axis (18) by means of a drive wheel (7) which is connected non-rotatably to the tensioning body and whose diameter is several times larger than that of the tensioning body (5). A safety catch (6) prevents the tensioning body (5) from turning backwards automatically into the locking position and allows the tensioning body (5) to turn backwards into the release position.

27 Claims, 2 Drawing Sheets

FOREIGN PATENT DOCUMENTS

Figure 1:
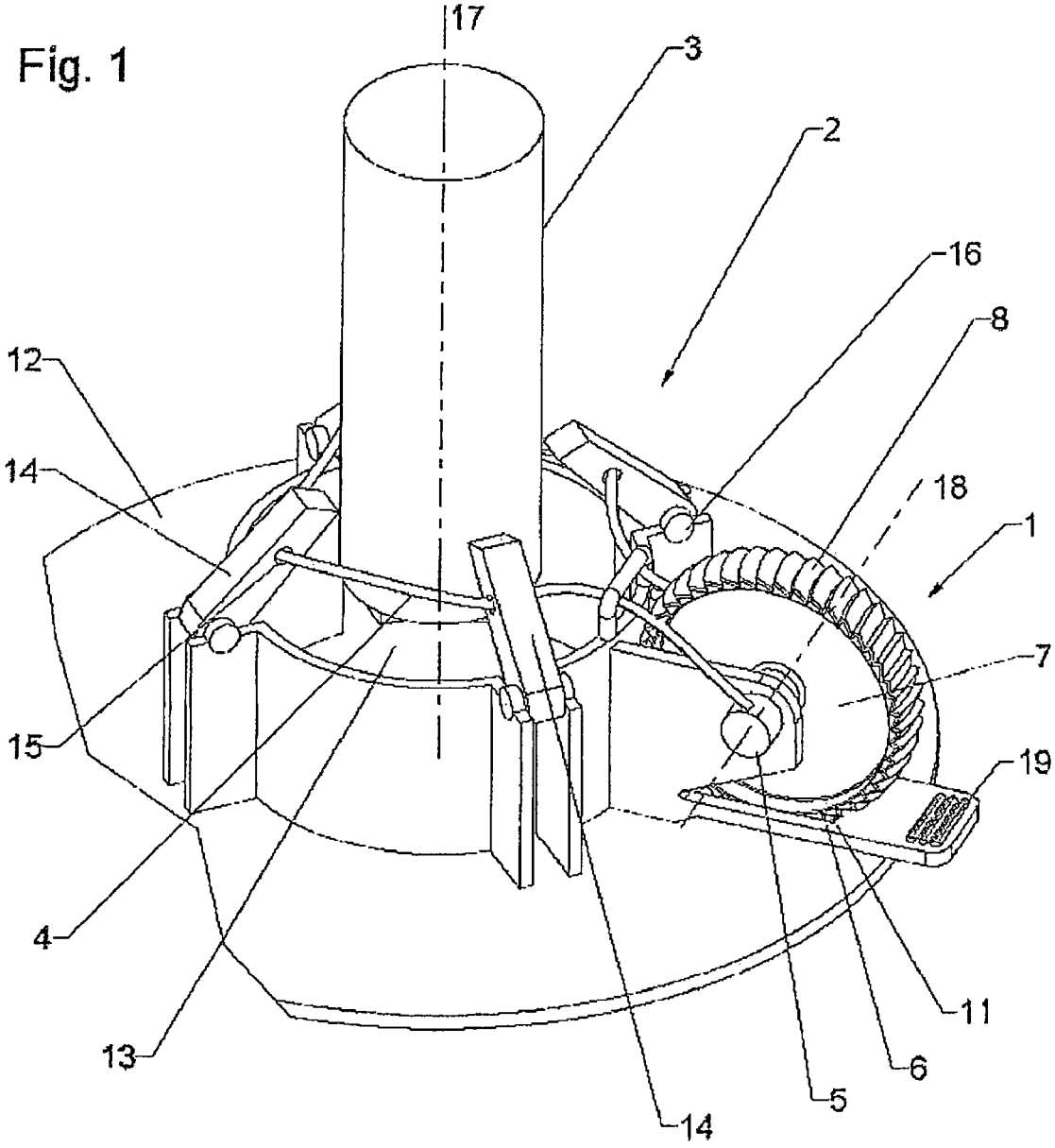

| | | |
|---|---|---|
| DE | 299 13 474 | 11/1999 |
| DE | 100 00 879 | 7/2001 |
| DE | 201 05 005 | 8/2001 |
| DE | 202 09 344 | 12/2002 |
| DE | 102 20 879 | 8/2003 |
| DE | 200 23 309 | 10/2003 |
| DE | 203 20 092 | 6/2004 |
| DE | 20 2004 020 005 | 5/2005 |
| DE | 20 2004 020 006 | 5/2005 |
| EP | 1 318 740 | 12/2004 |

* cited by examiner

TENSIONING DEVICE FOR USE AT A STAND FOR CLAMPING A ROD-SHAPED UNIT, PARTICULARLY A CHRISTMAS TREE, AND A STAND WITH A TENSIONING DEVICE

CROSS-REFERENCE TO RELATED APPLICATIONS

This application claims priority to German Application No. DE 10 2006 012 424.3 filed Mar. 17, 2006, the entire contents of which are herein incorporated by reference. The present invention is also related to U.S. patent application Ser. No. 11/723,177, now U.S. Pat. No. 7,347,400, entitled "Stand For Clamping A Rod-Shaped Unit, Particularly A Christmas Tree," and U.S. patent application Ser. No. 11/480,870 entitled "Holding Device For Rod-Shaped Components.", the entire contents of each of which are incorporated herein by reference.

The present invention relates to a tensioning device for use at a stand for clamping a rod-shaped unit, particularly a Christmas tree, and a stand for clamping a rod-shaped unit, particularly the Christmas tree, with a tensioning device of this type.

A number of stands for clamping Christmas trees, in particular, are known from the prior art, in which pivotable holding elements are pivoted by means of one or more flexible force transfer elements, which can be loaded in tension, and thus engage around the Christmas tree by clamping it. The flexible force transfer element is usually a steel cable or it consists of several steel cables. It is guided through guide openings located in the holding elements mostly above the pivot axes of the latter. The effective length of the at least one steel cable is shortened by the tensioning device located on the stand with the result that the holding elements are pivoted inwardly in the sense of resting against the rod-shaped unit.

Examples of this are disclosed in DE 39 32 473 C2, DE 102 20 879 A1, DE 39 32 432 C2 and DE 201 05 005 U1. Here, a single steel cable is guided in the form of a closed loop through all the holding elements and supplied to the winding roller of the tensioning device. The pivotable holding elements are arranged circularly or annularly around an axis of symmetry of the stand, which axis of symmetry simultaneously forms the longitudinal axis of the rod-shaped unit to be clamped. The winding roller of the tensioning device is aligned tangentially in relation to this axis of symmetry; thus it runs transversely to a radial direction in relation to the axis of symmetry.

The above-mentioned stands known from the prior art have proved to be of value in practice. However, there remains the desire to keep down the overall height of these stands. The tensioning device is a definite problem in this connection. In addition to the winding roller, it comprises a moveable tension lever, which rotates the winding roller incrementally in the form of a ratchet. The cable located on the winding roller is wound up and tightened increasingly when the ratchet is actuated. Furthermore, the actuation of the winding roller by means of a special, additional moveable lever involves the disadvantage of relatively complicated mechanics; the same applies to the manufacture and the assembly alike.

In DE 203 20 092 U1 another stand for clamping Christmas trees is disclosed, in which stand a tension lever is fixed, for example, inserted non-rotatably in the winding or tensioning body. The tension lever thus directly rotates the tensioning body. Here, the tensioning body has a larger diameter than in the case of tensioning devices having a winding roller, which is actuated in the form of a ratchet. In the case of the tensioning device disclosed in DE 203 20 092 U1, an axial safety catch (not described in detail) is provided between the tensioning body and a housing wall for locking the clamping position achieved. This safety catch serves for maintaining the clamping position once achieved even after the tension lever is released. Axial safety catches of this type are based on the fact that the part to be rotated, in this case the tensioning body, has to be axially displaceable in relation to a stationary locking part at least by the tooth height of the axial teeth forming the safety catch.

The stand disclosed in DE 203 20 092 U1 is based on the endeavor to arrange all the assembly parts of the stand below the upper edge of its seating region with the result that the entire stand can be covered in a closed manner by a housing with only the upper ends of the holding elements protruding, if necessary. The steel cable actuating the holding elements is therefore laid as deeply as possible in the stand and engages at the holding elements below their pivot axis according to a first embodiment. For this purpose, it is necessary to select a rope deviation that is complicated and involves friction or according to a second embodiment intermediate levers are required, which act on the holding elements and only thereby enable the desired inward movement of the holding elements when clamping the rod-shaped unit. Incidentally, due to the special objective of the invention, the tensioning device in the stand disclosed in DE 203 20 092 U1 is installed such that the axial direction of the winding or tensioning body runs radially in relation to the common axis of symmetry of the holding elements. This stand is indeed built in an appropriately more compact manner than the stands of the previously mentioned solutions particularly because the tensioning device is better integrated in the outer periphery of the stand. But for this purpose it puts up with a very complex, cumbersome design that is prone to failure.

Incidentally, what is common to all these tensioning devices or stands having a tensioning device is that they have selected a very cumbersome and accordingly expensive design with the tension lever—be it designed in the form of a ratchet or any other form or firmly integrated in the stand or push-fitted if necessary as in the case of DE 203 20 092 U1 and with the complex locking devices. In addition, this design is not entirely unsusceptible to failures due to wear and also contamination, in particular.

Accordingly, the object of the present invention is to design a tensioning device of the type mentioned in the introduction and a stand having a tensioning device of this type in such a way that it can be produced and mounted cost-effectively with easy operability and reliable operating mode particularly with respect to the clamping process.

This objective is attained by a tensioning device and by a stand having the features disclosed herein.

This tensioning device sets itself apart from the prior art by dispensing with a tension lever entirely.

Instead of that, a drive wheel is provided directly on the rotatable tensioning body, which is supported on the stand and on which the flexible force transfer element for clamping the rod-shaped unit can be wound up.

This drive wheel has the same rotation axis as the rotatable tensioning body. It can be preferably connected non-rotatably to the rotatable tensioning body or it can also be designed with the latter as a single piece, if necessary.

The drive wheel preferably has a diameter that is several times larger than that of the rotatable tensioning body. For example, the rotatable tensioning body can have a diameter of preferably 10 mm to 25 mm and the drive wheel can have a diameter of preferably 75 mm to 100 mm. This results in a transmission ratio, which in spite of the considerable forces required for tightening the flexible force transfer element, ensures an easy operation of the tensioning device.

The clamping process can be carried out then, for example by foot, particularly if the drive wheel, has a slide-retarding, particularly toothed design preferably in the region of its outer periphery particularly on the outer periphery itself. Here, it can be advantageous for the operation if the outer periphery of the drive wheel is provided with a convexly arched design towards its axis because then the drive wheel is better accessible particularly for operation by foot.

The tensioning device has a safety catch. The latter is designed such that it prevents the tensioning body from turning backwards automatically in a first position—the locking position, when tightening the force transfer element. However, the safety catch releases the tensioning body in a second position—the release position. That is, the safety catch allows the tensioning body to rotate in the sense of its unwinding. In this release position, the safety catch is thus completely decoupled.

The safety catch preferably engages at the drive wheel. It can be preferably designed in the form of a Hirth serration. However, the aim of the invention of providing a simple, cost-effective solution that is not prone to failure is better achieved if the safety catch engages preferably at the outer periphery of the drive wheel or in the vicinity thereof. This is because the slide-retarding design of this outer periphery can then also be utilized simultaneously for an easy, convenient clamping action and for blocking the tensioning body from turning backwards during the clamping process.

This results firstly in a particularly simple construction. At the same time, the advantage of this embodiment is that when the safety catch engages in the region of the outer periphery of the drive wheel, the advantageous transmission ratio present at this location is simultaneously also used for the blocking action. This results in the additional advantage that the restoring forces of the tensioning device which act on the safety catch are low, the safety catch can therefore also be detached in a particularly easy and wear-resistant manner and can accordingly be designed easily by cutting down on materials and costs.

This holds true notably if the drive wheel is preferably toothed on its outer periphery, particularly if the teeth are relatively large since they can considerably facilitate a more convenient foot operation.

It is particularly advantageous both for the clamping action and for the blocking action if the drive wheel preferably comprises teeth having blocking flanks and sliding flanks on its outer periphery in the form of a ratchet wheel because the teeth then have a particularly good grip for the blocking process.

A design in which the surface of the blocking flank is aligned radially is particularly advantageous because then the blocking action is ensured on the one hand and on the other hand the least possible forces counteract the release action.

The safety catch can basically engage at the drive wheel preferably by means of a friction locking. This is particularly conceivable if the safety catch engages at the outer periphery of the drive wheel or in the vicinity of said outer periphery, where the forces required for the blocking action are small. This comes into consideration particularly if the drive wheel or even the safety catch or both are provided with a slide-retarding design.

However, a more reliable design results when the drive wheel is preferably formed as a ratchet wheel and the safety catch is a pawl, which engages at least one of the blocking flanks in the locking position.

In order to prevent the tensioning body from turning backwards in any phase of the clamping process, it makes sense to resiliently pre-stress the safety catch towards the outer periphery of the drive wheel.

The simplest, most cost-effective design results when the safety catch itself is preferably designed as a resilient pawl, which is pre-stressed towards the outer periphery of the drive wheel.

If the drive wheel then comprises teeth having blocking flanks and sliding flanks on its outer periphery in the form of a ratchet wheel, the pawl automatically slides (when the flanks are aligned appropriately) against the spring force over the sliding flanks in the form of a ratchet into the respective locking position during the clamping process. Thus the pawl does not prevent the clamping process, but rather prevents the tensioning body from turning backwards in any phase of the clamping process.

If the rod-shaped unit is supposed to be released, then for this purpose it is sufficient to launch the pawl into the release position largely without the application of force.

In order to enable the release of the pawl easily, for example, even by foot, said pawl is preferably provided with a control element, which in its simplest design is formed preferably as a simple extension of the pawl, protrudes outwardly and is thus accessible for operation and is molded on to the pawl.

However, in this case it is important that an inadvertent release is prevented, this being possible particularly easily in the device according to the patent because it is designed for smooth movement, as described already. To this end, locking devices of any type are conceivable on the one hand. However, it is simpler, more secure and simultaneously more cost-effective to attach the control element to the pawl preferably in a push-fit manner or detachably in any other manner. Then it can also be protected separately e.g. from children playing, safeguarded and attached only for activating the release position.

The drive wheel of the tensioning device is preferably arranged in a housing in such a way that its outer periphery, especially of its profile or its teeth, protrudes from the upper side of the housing. Preferably the outer periphery of the drive wheel protrudes from the upper side of the housing in a quadrant of preferably 45° to 60°. That is, the drive wheel is freely accessible in this region, particularly for a foot operation.

Another object of the present invention is a stand for clamping a rod-shaped unit, particularly a Christmas tree, said stand comprising a foot part, with a seating region for the lower end of the rod-shaped unit, said seating region being located on the foot part, with several holding elements arranged around an axis of symmetry, each of said holding elements being pivotable in a plane between an open position and a holding position, said planes intersecting approximately in the axis of symmetry and with at least one flexible force transfer element, which can be loaded in tension and which is guided through guide openings in the holding elements preferably above their pivot axes, wherein by tightening the flexible connecting part by means of a tensioning device, the holding elements are pivoted inwardly in the sense of resting against the rod-shaped unit, with a tensioning device. Preferably two, three or four force transfer elements can be provided, each force transfer element impinging on a holding element or a group of holding elements. Simple holding elements or those having so-called double claws as described by way of example in PCT/EP 01/10039 can be used as holding elements.

The tensioning device can be installed in the stand such that its rotation axis runs radially in relation to the axis of symmetry of the stand, if this seems to make sense for reasons of saving space. Basically, however, it is preferable to install the tensioning device such that the rotation axis of the tensioning body runs preferably tangentially to the axis of symmetry.

Figure 2A:
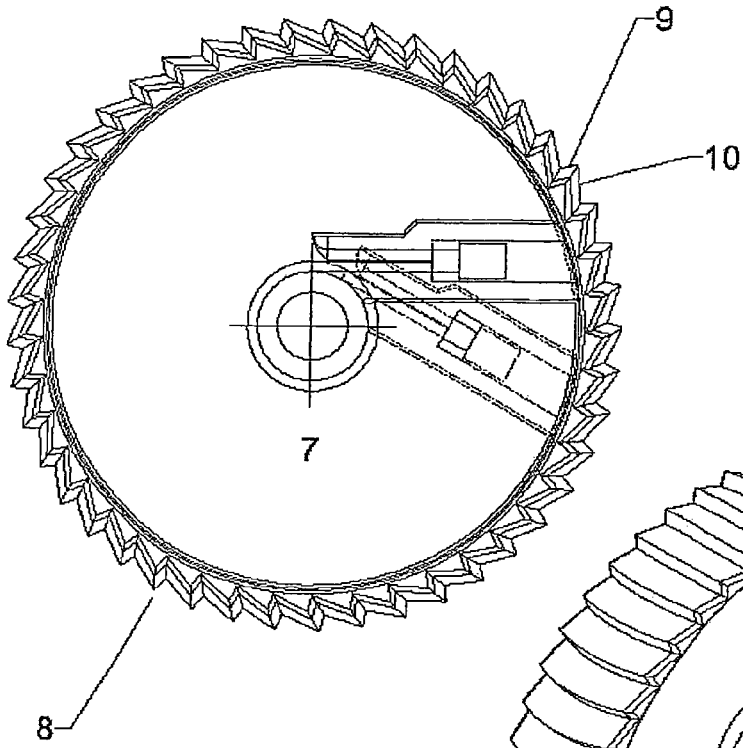
Figure 2B:
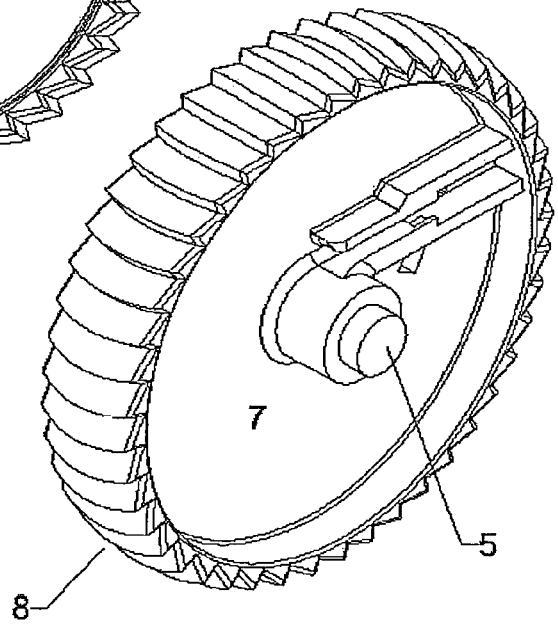

The present invention will now be explained in detail in the following with reference to the exemplary embodiments illustrated in the drawings, of which:

FIG. 1: shows a stand having a tensioning device according to the present invention; and FIG. 2*a* shows a side elevational view of a drive wheel having a toothed outer periphery;

FIG. 2*b* shows a perspective view of the drive wheel in FIG. 2*a*; and

Figure 2C:
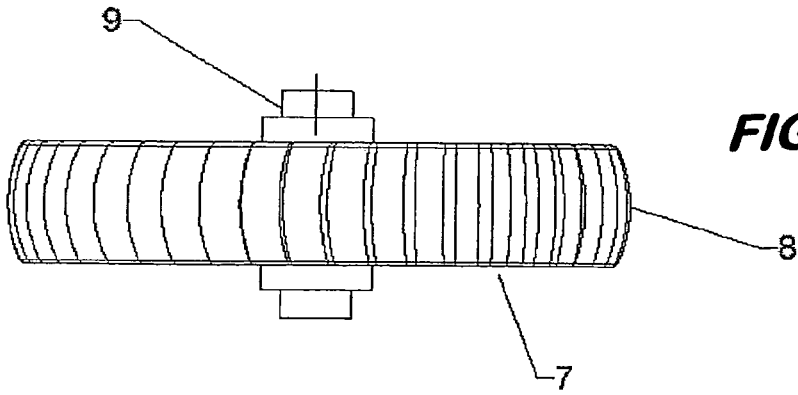

FIG. 2*c* shows a top plan view of the drive wheel in FIG. 2*a*.

FIG. 1 shows the stand 2 for clamping a rod-shaped unit 3, said stand comprising a foot part 12, a seating region 13 and holding elements 14, which can be moved about the pivot axes 16 towards the axis of symmetry 17 of the stand against the force of return springs, if necessary, for the purpose of clamping the rod-shaped unit. The holding elements 14 can be moved with the help of the flexible force transfer element 4, preferably a steel cable, which penetrates all the holding elements 14 by sliding through guide openings 15.

For clamping the rod-shaped unit 3, the flexible force transfer element 4 is tightened in the tensioning device 1 which is supported on the stand 2. The tensioning device 1 comprises a rotatable tensioning body 5 on which the flexible force transfer element 4 is wound for clamping the holding elements 14. For actuating the tensioning body, a drive wheel 7 is provided which is non-rotatably connected to the tensioning body 5 with the same rotation axis 18 or is also molded on to it in certain circumstances. The drive wheel 7 has a diameter that is several times, for example ten times, larger than that of the tensioning body 5. The transmission thus achieved enables an easy clamping and blocking action in spite of the high tension forces required.

A safety catch 6 engages at the drive wheel 7, preferably from below as illustrated, in the region of the outer periphery of the drive wheel 7. It is pre-stressed resiliently towards the drive wheel 7 or is itself designed resiliently and pre-stressed towards the drive wheel 7.

The drive wheel 7 has a toothed design, in fact in the form of a ratchet wheel, with blocking flanks 9 and sliding flanks 10. Said flanks are aligned in such a way that the safety catch 6 designed as a pawl 11 slides over the sliding flanks 9 towards the blocking flanks 10 when tightening the flexible force transfer element 4 and thus, in the form of a ratchet, prevents the tensioning body 5 from automatically turning backwards into any position.

The safety catch 6, which is supported here below the drive wheel 7, has a control element 19, which is designed in its simplest form as a region extending the pawl and protruding outwardly. Using the control element, the pawl can be pressed, for example by foot, out of the locking position and into the release position—thus downwardly in the embodiment illustrated, in which case the pawl releases the drive wheel 7 and with it the tensioning body, the force transfer element and thus finally the tree trunk.

The control element can be designed to be detachable so that the safety catch cannot be activated inadvertently, for example, by playing children. Then it can be safeguarded in the form of a key until it is required for activating the release position. Like a key, and just like the associated receptacle on the pawl or on the tensioning device itself, the control element can even be designed such that it is possible to operate only using this control element, thereby making the locking mechanism particularly reliable.

FIGS. 2*a*-2*c* show in detail various views of the drive wheel 7 with its teeth, particularly with its blocking flanks 9 and sliding flanks 10 and the convex arch of its outer periphery. In the interior of the drive wheel 7, bars (not labeled) are provided on both the sides of a continuous carrier of the teeth of the drive wheel 7, which bars serve for inserting and fixing the respective ends of the force transfer element.

LIST OF REFERENCE NUMERALS

1 Tensioning device
2 Stand for clamping a rod-shaped unit
3 Rod-shaped unit
4 Flexible force transfer element
5 Tensioning body
6 Safety catch
7 Drive wheel
8 Outer periphery of the drive wheel
9 Blocking flanks
10 Sliding flanks
11 Pawl
12 Foot part
13 Receiving part
14 Holding elements
15 Guide openings
16 Pivot axes of the holding elements
17 Axis of symmetry of the stand
18 Rotation axis of the tensioning body
19 Control element

The invention claimed is:

1. A tensioning device for use on a stand for clamping a rod-shaped unit, said tensioning device having a single actuating element in the form of a rotatably mounted drive wheel having a toothed outer periphery and an integrally formed hub around which a first end of at least one flexible force transfer element, which can be loaded in tension, is wound, wherein the rotation of the drive wheel shortens the length of the force transfer element thereby clamping the rod-shaped unit in the stand, a safety catch positioned adjacent the drive wheel to prevent the drive wheel from turning backwards automatically in a first, locking position when tightening the flexible force transfer element, and allows the drive wheel to turn backwards in a second release position, wherein the drive wheel has a diameter several times larger than that of the hub.

2. The tensioning device according to claim 1, wherein the drive wheel has a common axis with the hub and is non-rotatably connected thereto.

3. The tensioning device according to claim 1, wherein the drive wheel is molded on to the hub.

4. The tensioning device according to claim 1, wherein the safety catch engages the drive wheel.

5. The tensioning device according to claim 4, wherein the safety catch engages at the drive wheel in the form of a Hirth serration.

6. The tensioning device according to claim 4, wherein the safety catch engages in the region of the outer periphery of the drive wheel.

7. The tensioning device according to claim 6, wherein the region of the outer periphery of the drive wheel is provided with a slide-retarding design.

8. The tensioning device according to claim 7, wherein the safety catch engages at the drive wheel by means of a friction locking.

9. The tensioning device according to claim 7 wherein the safety catch is resiliently pre-stressed towards the outer periphery of the drive wheel.

10. The tensioning device according to claim 6, wherein the drive wheel is toothed in the region of its outer periphery.

11. The tensioning device according to claim 10, wherein the drive wheel comprises teeth with blocking flanks and sliding flanks in the region of its outer periphery in the form of a ratchet wheel.

12. The tensioning device according to claim 11, wherein the safety catch is designed as a pawl, which engages at least one of the blocking flanks in the locking position.

13. The tensioning device according to claim 12 wherein the safety catch is resiliently pre-stressed towards the outer periphery of the drive wheel.

14. The tensioning device according to claim 6, wherein the outer periphery of the drive wheel is convexly arched towards an axis of the drive wheel.

15. The tensioning device according to claim 14 wherein the safety catch is resiliently pre-stressed towards the outer periphery of the drive wheel.

16. The tensioning device according to claim 6 wherein the safety catch is resiliently pre-stressed towards the outer periphery of the drive wheel.

17. The tensioning device according to claim 16, wherein the safety catch is designed as a pawl, which is resiliently pre-stressed towards the outer periphery of the drive wheel.

18. The tensioning device according to claim 17, further including a control element molded on to the pawl for transferring the pawl into the release position.

19. The tensioning device according to claim 18, wherein the safety catch is secured from being released inadvertently.

20. The tensioning device according to claim 1, wherein the control element secures the safety catch from being released inadvertently.

21. The tensioning device according to claim 1, wherein the drive wheel is arranged in a housing and a portion of an outer periphery thereof protrudes beyond an upper side of the housing.

22. The tensioning device according to claim 21, wherein the drive wheel protrudes from the upper side of the housing in a quadrant of 45° to 60° and is freely accessible there.

23. A stand for clamping a rod-shaped unit comprising a foot part, a seating region for a fixing end of a rod-shaped unit, an outer housing, said seating region being located on the foot part, a plurality of holding elements arranged around an axis of symmetry, each of said holding elements being pivotable between an open position and a holding position against the rod shaped unit, at least one flexible force transfer element for pivoting the holding elements inwardly toward and against the rod-shaped unit, having a single actuating element in the form of a rotatably mounted drive wheel having an integrally formed hub and a toothed exterior with at least a portion of the drive wheel periphery extending outwardly through the housing, one end of the force transfer element being wound upon the hub so that as the drive wheel is rotated the length of the force transfer element is tensioned and shortened to thereby clamp the rod shaped unit, and a safety catch which moves between a first locking position which prevents the drive wheel from turning backwards and a second release position which allows the drive wheel to turn backwards and release tension on the force transfer element and the drive wheel having a diameter several times larger than the diameter of the hub.

24. The stand according to claim 23, wherein the drive wheel is installed with a rotation axis running tangentially in relation to the axis of symmetry.

25. The stand according to claim 23 wherein the control element is detachably mounted.

26. The stand as in claim 23 wherein the toothed exterior of the drive wheel extends toward an axis of the hub.

27. The stand as in claim 23 wherein the exterior of the drive wheel is convexly curved.

* * * * *